US006814604B2

(12) United States Patent
Lee

(10) Patent No.: US 6,814,604 B2
(45) Date of Patent: Nov. 9, 2004

(54) SOCKET CONNECTOR WITH RESILIENTLY ENGAGED ACTUATOR MECHANISM

(75) Inventor: Genn-Sheng Lee, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/412,528

(22) Filed: Apr. 10, 2003

(65) Prior Publication Data

US 2004/0018768 A1 Jan. 29, 2004

(30) Foreign Application Priority Data

Jul. 26, 2002 (TW) ..... 91211451 U

(51) Int. Cl.[7] ..... H01R 4/50
(52) U.S. Cl. ..... 439/342
(58) Field of Search ..... 439/342, 266, 439/70

(56) References Cited

U.S. PATENT DOCUMENTS 5,167,515 A 12/1992 Matsuoka et al. ..... 439/108
5,443,591 A * 8/1995 Tsai ..... 439/342
5,454,727 A * 10/1995 Hsu ..... 439/263
5,489,218 A * 2/1996 McHugh ..... 439/342
5,562,474 A * 10/1996 Lee ..... 439/342
5,569,045 A * 10/1996 Hsu ..... 439/342
5,679,020 A * 10/1997 Lai et al. ..... 439/342
5,697,803 A 12/1997 Kistner et al. ..... 439/342
5,947,778 A 9/1999 Lai et al. ..... 439/876
6,371,785 B1 * 4/2002 Howell et al. ..... 439/342
6,371,786 B1 4/2002 Howell et al. ..... 439/342
6,471,536 B1 * 10/2002 Chen et al. ..... 439/342
6,508,659 B1 * 1/2003 Howell et al. ..... 439/342
6,599,146 B2 * 7/2003 Liao ..... 439/342
6,638,093 B1 * 10/2003 Chang ..... 439/342

FOREIGN PATENT DOCUMENTS

TW 241962 2/1995

OTHER PUBLICATIONS

Author: Peter Baker and Tim Hopt Title of the article:Development of ZIF BGA Socket Name of the Journal:Connector Specifier Magazine Web Site: http://cs.pennnet.com/home.cfm Issue Date:May, 2000.

* cited by examiner

*Primary Examiner*—Tulsidas C. Patel
(74) *Attorney, Agent, or Firm*—Wei Te Chung

(57) ABSTRACT

A socket connector (1, 1') for electrically connecting an IC package and a PCB includes a base (2, 2'), a cover (3, 3') slidably mounted on the base, an actuator mechanism (4, 4') sandwiched between the cover and the base, and a plurality of terminals received in the base. The cover has a side wall (304, 304') forming an engaging member (306, 306') thereon. The actuator mechanism includes an actuating lever (43, 43') having mating means (432, 4322) protruding toward the side wall of the cover. The mating means mates with the engaging member to prevent the actuating lever from springing back from position. Thus the IC package is securely mounted on the connector. Additionally, the actuating lever is spaced from the side wall of the cover, thereby allowing convenient operation of the actuating lever.

15 Claims, 5 Drawing Sheets

SOCKET CONNECTOR WITH RESILIENTLY ENGAGED ACTUATOR MECHANISM

BACKGROUND OF THE INVENTION

1. Field of the Invention

The present invention relates to a socket connector, and more particularly to a central processing unit (CPU) socket connector for electrically connecting a CPU package and a printed circuit board (PCB).

2. Description of the Prior Art

With the trend toward miniaturization of electronic components, manufacturing and assembling tolerances are becoming increasingly stringent. Accurate orientation of electronic components in an apparatus can be highly problematic. As a result, reliability of electrical connection between electronic components is liable to be compromised.

Conventional socket connectors for electrically connecting an integrated circuit (IC) package such as a CPU package with a PCB are described in "Development of ZIF BGA Socket," which is obtained from the web journal "Connector Specifier" (May 2000). Similar socket connectors are also disclosed in U.S. Pat. Nos. 5,167,515, 5,697,803, 5,947,778, 6,371,786 and Taiwan Pat. Issue No. 241962.

Each such conventional socket connector comprises a base, a cover slidably mounted on the base, an actuator mechanism embedded between the cover and the base, and a plurality of terminals received in the base. The actuator mechanism includes a shaft, and an actuating lever perpendicularly extending from one end of the shaft. An offset portion is formed in the shaft. A protruding block is formed on a lateral side of the base. After assembly, the actuating lever is operated to rotate the offset portion of the shaft, such that the offset portion urges the cover to slide relative to the base. As a result, the CPU package is mounted on the connector.

However, in the mounted position, the cover urges the offset portion. Further, the connector has no stopper means to prevent the actuating lever from springing back out from position. Thus the cover is prone to slide back relative to the base, even to the point where pins of the CPU package disengage from their respective terminals. When this happens, electrical connection between the CPU package and the connector is disrupted or lost altogether.

In order to overcome the above-mentioned problems, another socket connector as shown in FIGS. 5 and 6 has been devised. The connector includes a base 6, a cover 7 slidably mounted on the base 6, an actuator mechanism 8 embedded between the cover 7 and the base 6, and a plurality of terminals 9 received in the base 6. The actuator mechanism 8 includes a shaft 81, and an actuating lever 82 perpendicularly extending from one end of the shaft 81. An offset portion 810 is formed in the shaft. A stopper block 61 is disposed at one lateral side of the base 6. A positioning block 71 is formed at one lateral side of the cover 7. When the cover 7 is at a closed position in which the CPU package is fully assembled on the connector, the stopper block 61 and the positioning block 71 cooperatively define a space therebetween holding the actuating lever 82 therein.

However, because of manufacturing and assembly tolerances of the connector, the actuating lever 82 may easily be located away from the lateral side of the cover 7. As a result, the actuating lever 82 may be only partially engaged in said space. When this happens, the actuating lever 82 can easily springs back out from its position under the positioning block 71. Electrical connection between the CPU package and the connector is disrupted or lost altogether. In addition, the actuating lever 82 is situated close to the lateral side of the cover 7, which makes it inconvenient to operate the actuating lever 82.

Thus, there is a need to provide an improved socket connector that overcomes the above-mentioned problems.

SUMMARY OF THE INVENTION

Accordingly, a main object of the present invention is to provide an improved socket connector for electrical connection between a CPU package and a PCB, wherein the CPU package can be securely and reliably mounted on the connector, and the connector can be conveniently operated by a user.

To fulfill the above object, the present invention provides a socket connector for electrically interconnecting a CPU package and a PCB. The socket connector includes a base, a cover slidably mounted on the base, an actuator mechanism sandwiched between the cover and the base, and a plurality of terminals received in the base. Two side walls depend from opposite lateral edges of the cover. An engaging member is provided on one of the side walls of the cover. The actuator mechanism comprises a shaft, and an actuating lever extending perpendicularly from one end of the shaft. The actuating lever defines mating means protruding toward said side wall of the cover. The mating means mates with the engaging member to prevent the actuating lever from springing back out from position. Thus the IC package is securely mounted on the connector. Additionally, the actuating lever is spaced from said side wall of the cover, thereby providing convenient operation of the actuating lever.

Other objects, advantages and novel features of the present invention will become more apparent from the following detailed description taken in conjunction with the accompanying drawings, in which:

DESCRIPTION OF PREFERRED EMBODIMENTS OF THE INVENTION

Reference will now be made to the drawings to describe the present invention in detail.

Figure 1:
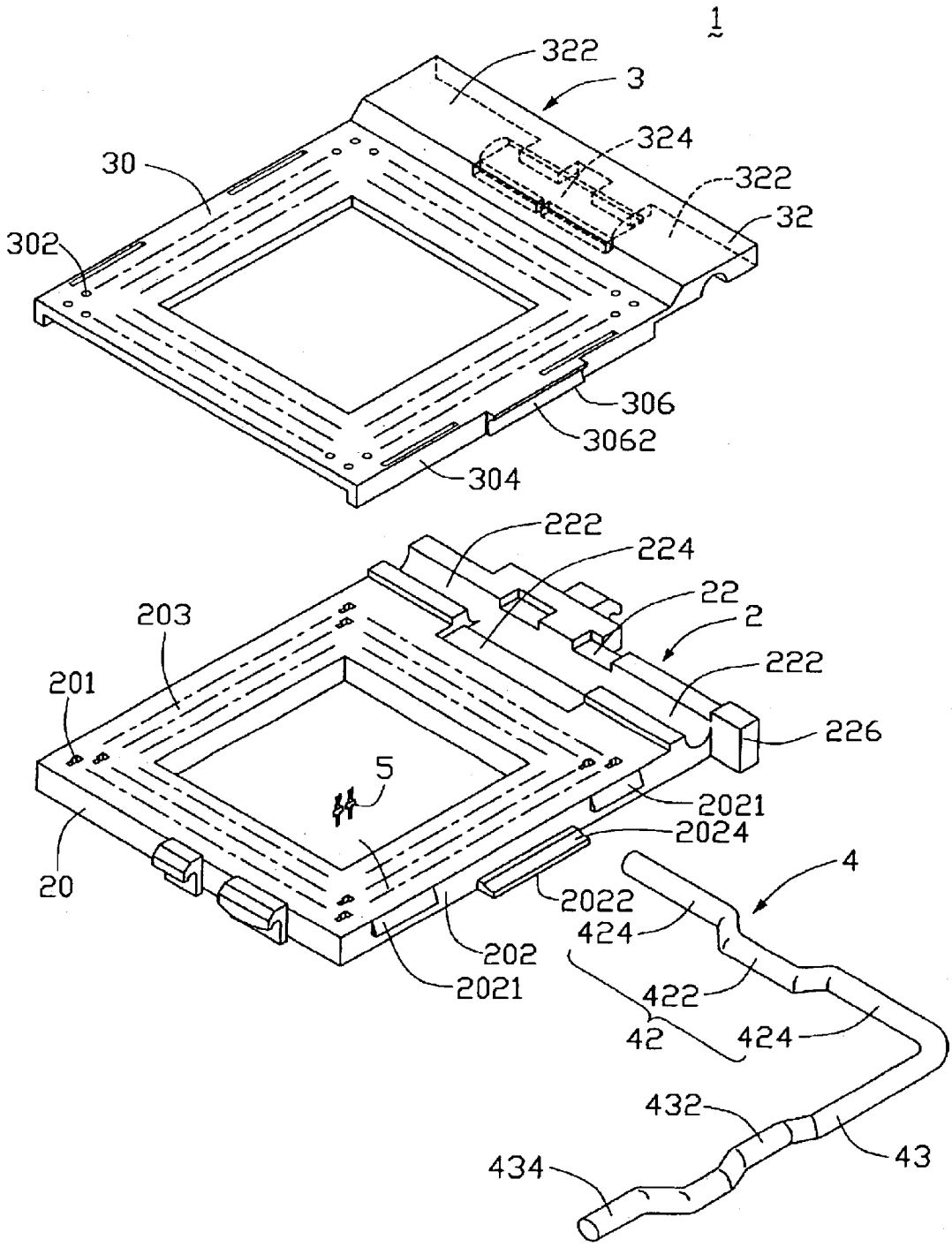
FIG. 1 is a simplified, exploded isometric view of a socket connector according to a first preferred embodiment of the present invention.

Referring to FIG. 1, according to the first preferred embodiment of the present invention, a socket connector 1 is for electrically connecting an IC package such as a CPU package (not shown) with a PCB. The socket connector 1 comprises a base 2, a cover 3 slidably mounted on the base 2, an actuator mechanism 4 sandwiched between the cover 3 and the base 2, and a plurality of terminals 5 received in the base 2.

The base 2 is substantially rectangular, and comprises a generally rectangular terminal receiving section 20. A first actuator receiving section 22 extends unitarily from one end of the terminal receiving section 20. An array of terminal-passages 201 is defined in the terminal receiving section 20, for receiving the corresponding terminals 5 therein. The terminal receiving section 20 comprises opposite lateral sides 202, and a mounting face 203 interconnecting the lateral sides 202. Two spaced protrusion blocks 2021 are formed on each lateral side 202, for holding the cover 3 on the base 2. A stopper block 2022 extends outwardly from one of the lateral sides 202, at a bottom thereof. The stopper block 2022 is configured with an arcuate mating face 2024. Two aligned, arcuate first receiving openings 222 are defined at opposite ends of the first actuator receiving section 22. A first cavity 224 is defined in the first actuator receiving section 22, between the first receiving openings 222. A stopper extrusion 226 extends from one end of the first actuator receiving section 22 that corresponds to the stopper block 2022. The stopper extrusion 226 prevents the actuator mechanism 4 from being over-rotated.

The cover 3 is substantially rectangular, and comprises a rectangular hole section 30 corresponding to the terminal receiving section 20 of the base 2. A second actuator receiving section 32 extends from one end of the hole section 30, corresponding to the first actuator receiving section 22 of the base 2. A plurality of holes 302 is defined in the hole section 30 corresponding to the terminal-passages 201 of the base 2, for insertion of pins of the CPU package (not shown) therethrough respectively. Two lateral side walls 304 depend from opposite lateral edges of the hole section 30 respectively. A pair of rectangular cutouts (not labeled) is defined in each side wall 304, for slidably receiving corresponding protrusion blocks 2021 of the base 2 therein.

Two arcuate second receiving openings 322 are defined in the second actuator receiving section 32, corresponding to the first receiving openings 222 of the base 2. A second cavity 324 is defined in the second actuator receiving section 32 between the second receiving openings 322, corresponding to the first cavity 224 of the base 2. A positioning protrusion 306 extends outwardly from one of the side walls 304, corresponding to the stopper block 2022 of the base 2. The positioning protrusion 306 is configured with an arcuate mating face 3062.

The actuator mechanism 4 is substantially L-shaped, with a circular cross-section. The actuator mechanism 4 comprises a shaft 42, and an actuating lever 43 extending perpendicularly from one end of the shaft 42. Two positioning portions 424 are defined at opposite ends of the shaft 42. An offset actuating portion 422 is defined between the positioning portions 424, for urging the cover 3 to slide relative to the base 2. A medial protruding portion 432 is defined in the actuating lever 43, and a holding portion 434 is defined at a distal end of the actuating lever 43. The protruding portion 432 of the actuating lever 43 protrudes inwardly from a main axis of the actuating lever 43. Therefore remaining parts of the actuating lever 43 are spaced from the corresponding side wall 304 of the cover 3. The holding portion 434 is for manual operation by a user. As a result of the above-described configuration, the actuator lever 43 is conveniently operated by the user.

In assembling the socket connector 1, the shaft 42 of the actuator mechanism 4 is embedded between the cover 3 and the base 2. The protrusion blocks 2021 of the base 2 are pressed into the cutouts of the cover 3, thereby mounting the cover 3 on the base 2. The first and second receiving openings 222, 322 cooperatively positioningly receive the positioning portion 424 of the shaft 42 therein. The first and second cavities 224, 324 cooperatively provide room for the actuating portion 422 to rotate about an axis of the shaft 42, such that the actuating portion 422 can press opposite walls of the second actuator receiving section 32 at the second cavity 324. Thus the actuating portion 422 can urge the cover 3 to slide relative to the base 2 between an open position in which the actuating lever 43 is substantially perpendicular to the mounting face 203 of the base 2, and a closed position in which the actuating lever 43 is substantially parallel to the mounting face 203. In addition, the mating face 2024 of the stopper block 2022 of the base 2 and the mating face 3062 of the positioning protrusion 306 of the cover 3 cooperatively define a space therebetween for holding the protruding portion 432 of the actuator mechanism 4 therein.

Figure 2:
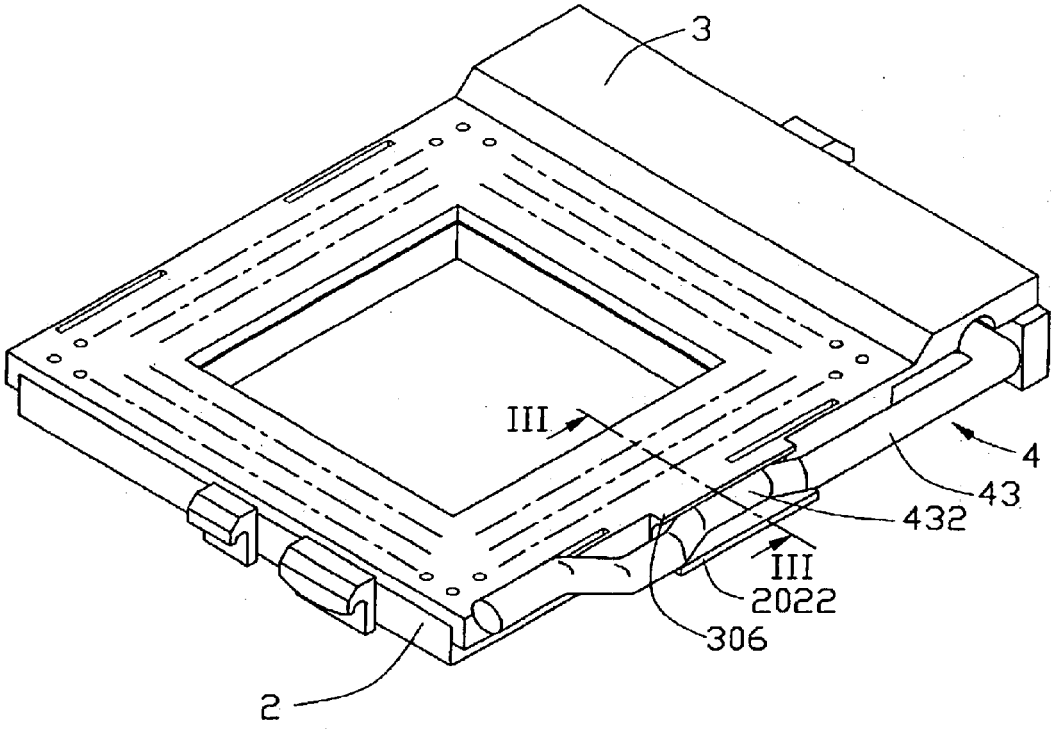
FIG. 2 is an assembled view of FIG. 1.
Figure 3:
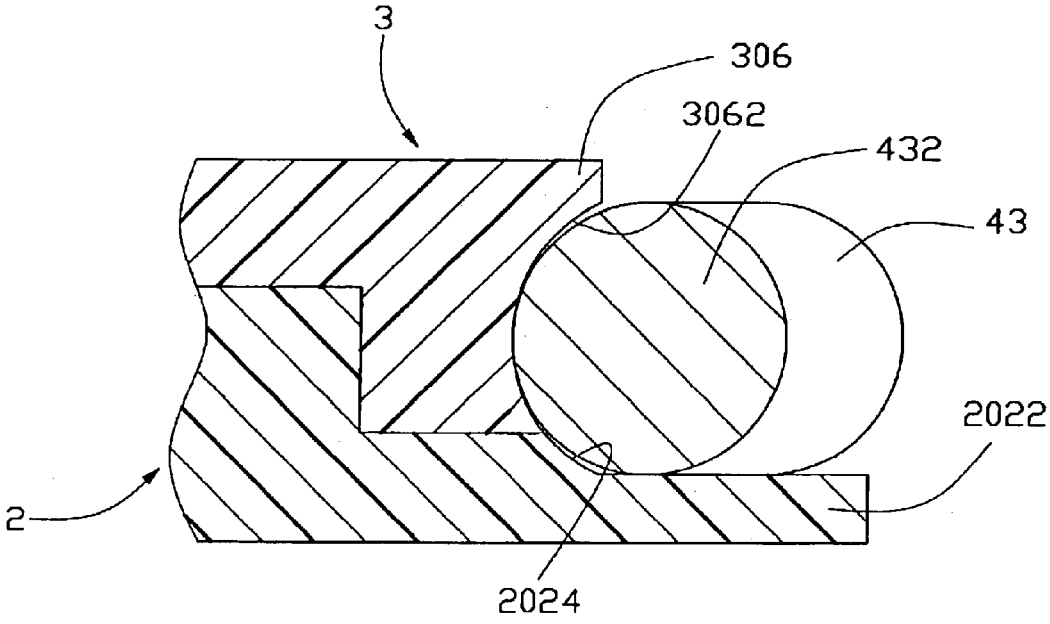
FIG. 3 is a cross-sectional view taken along line III—III of FIG. 2.

Referring to FIGS. 2 and 3, in use, the CPU package (not shown) is attached on the socket connector 1. The cover 3 is slid to the closed position. Thus the pins of the CPU package are mated with the terminals 5 respectively. Simultaneously, the protruding portion 432 of the actuator mechanism 4 is resiliently received in the space between the mating faces 2024, 3062. The actuating portion 422 of the actuator mechanism 4 resiliently presses on a corresponding wall of the second actuator receiving section 32 in the second cavity 324. Therefore the protruding portion 432 of the actuating lever 43 resiliently presses on the mating face 3062 of the positioning protrusion 306 of the cover 3. Accordingly, a static friction is generated between the mating face 3062 of the cover 3 and the protruding portion 432, so that the positioning protrusion 306 of the cover 3 prevents the actuating lever 43 from springing back from position. The CPU package is thus securely mounted on the socket connector 1. Reliable electrical connection and data transmission between the CPU package and the socket connector 1 is assured.

The protruding portion 432 of the actuating lever 43 protrudes nearer the side wall 304 of the cover 3 than remaining parts of the actuating lever 43. Therefore the protruding portion 432 of the actuating lever 43 can firmly mate with the positioning protrusion 306 of the cover 3, notwithstanding manufacturing and assembly tolerances of the socket connector 1. Additionally, because remaining parts of the actuating lever 43 are spaced from the side wall 304 of the cover 3, the actuating lever 43 can be conveniently operated by a user.

Figure 4:
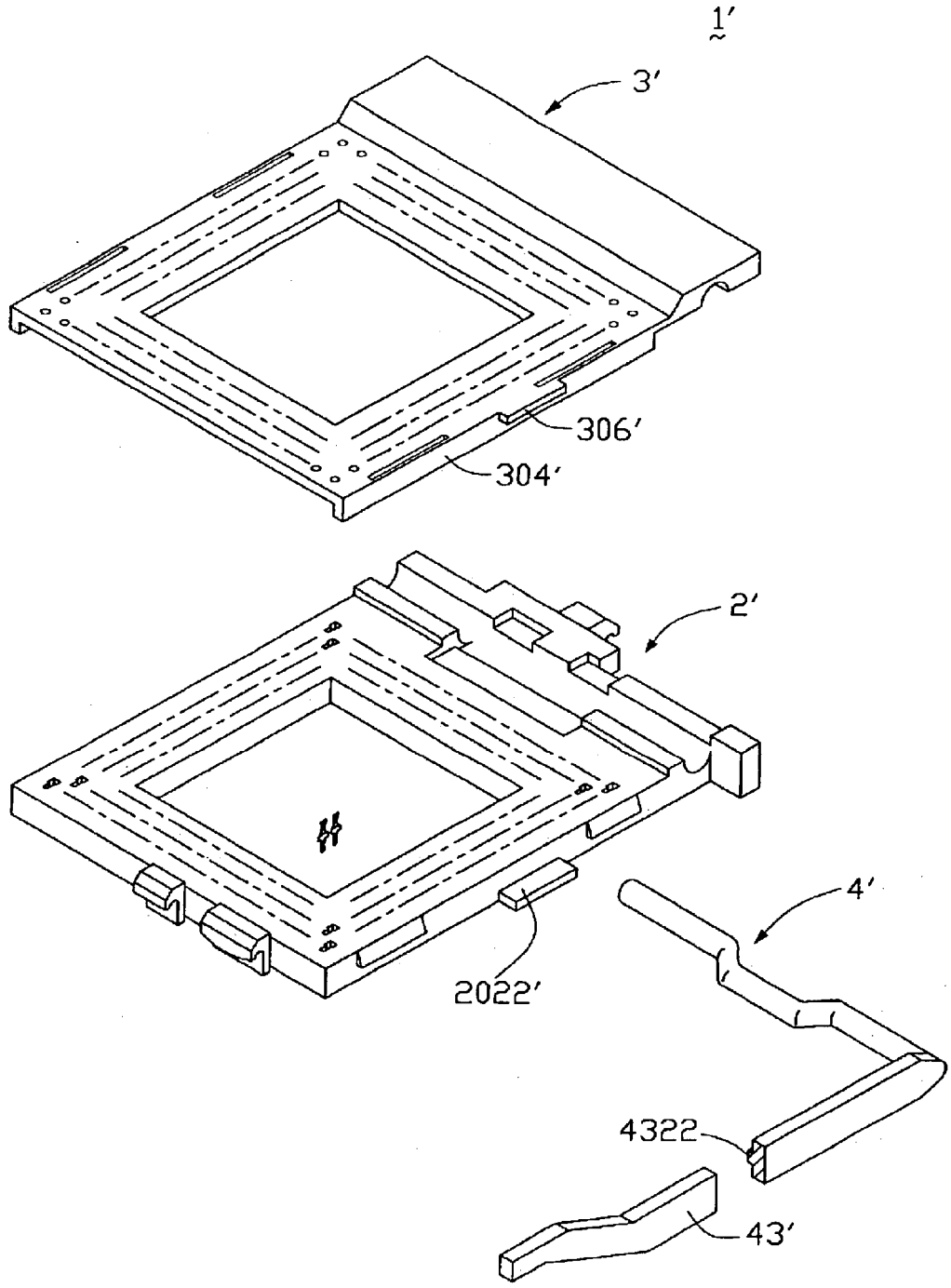
FIG. 4 is a simplified, exploded isometric view of a socket connector according to a second preferred embodiment of the present invention.
Figure 5:
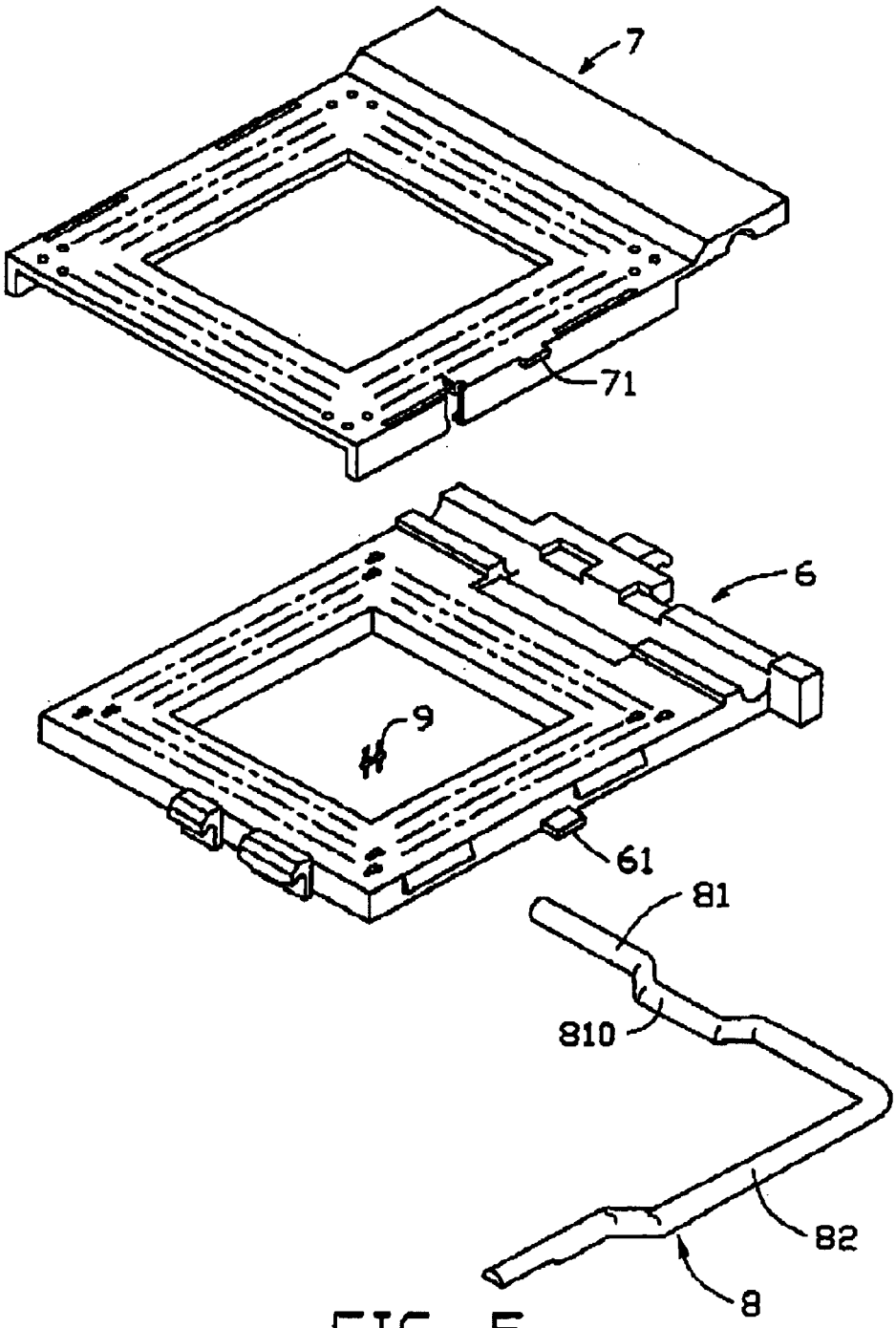
FIG. 5 (PRIOR ART)
FIG. 5 is a simplified, exploded isometric view of a conventional socket connector.
Figure 6:
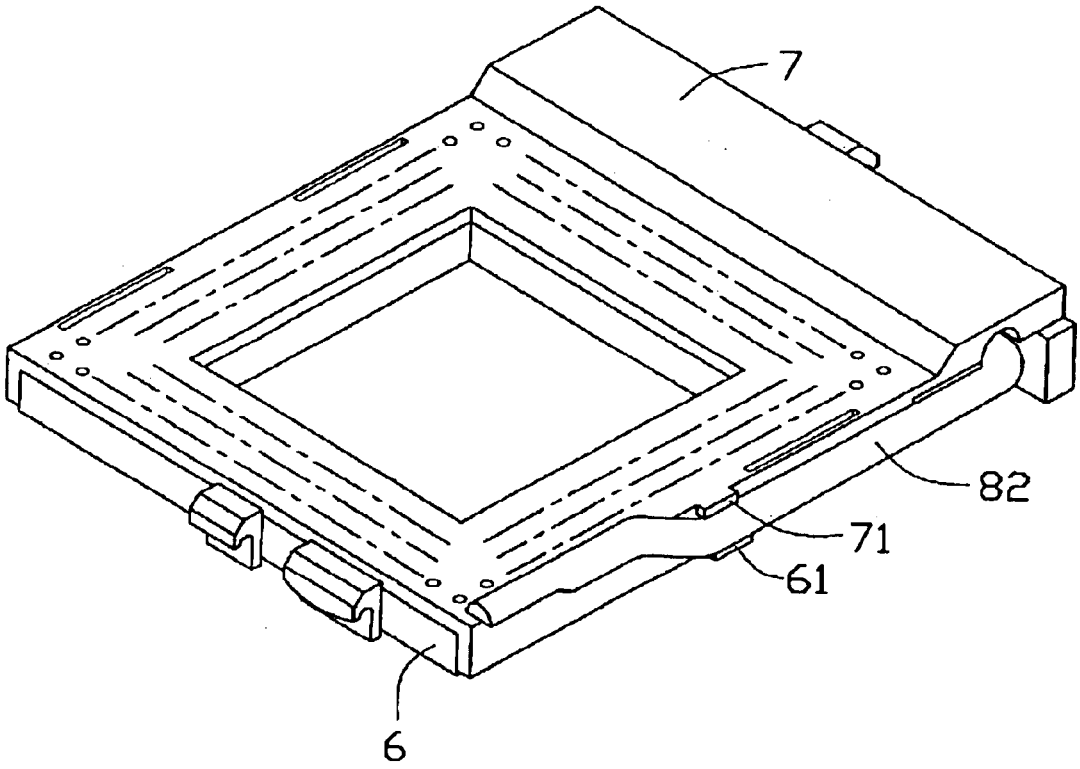
FIG. 6 (PRIOR ART)
FIG. 6 is an assembled view of FIG. 5.

FIG. 4 shows a socket connector 1' of the second preferred embodiment of the present invention. The socket connector 1' has a similar structure to that of the socket connector 1 of the first preferred embodiment, except for the following. An actuating lever 43' of an actuator mechanism 4' has a rectangular cross-section, and forms a protruding rib 4322 extending toward a side wall 304' of a cover 3'. The rib 4322 has a rectangular cross-section. A cover 3' and a base 2' respectively form a plate-shaped extrusion 306' and a block 2022' at corresponding sides thereof. The extrusion 306' and the block 2022' cooperatively define a space therebetween for receiving the protruding rib 4322 of the actuating lever 43', thereby preventing the actuating lever 43' from springing back from position. The socket connector 1' of the second preferred embodiment provides substantially the same functions as the socket connector 1 of the first preferred embodiment.

In the above-described socket connectors 1, 1', the cover 3, 3' holds the actuating lever 43, 43' in position by way of resilient engagement. In the socket connector 1, said engagement is between the positioning protrusion 306 and the protruding portion 432. In the socket connector 1', said engagement is between the protruding rib 4322 and the extrusion 306'. It should be understood that other alternative means of resilient engagement between the cover 3, 3' and the actuating lever 43, 43' may alternatively be provided by other forms of mechanical engagement. Various resilient engagement means may be adopted, and each such engagement means may be best suited to the particular detailed configuration of the socket connector 1, 1' that may be provided.

Although the present invention has been described with reference to the above particular embodiments, it is not to be construed as being limited thereto. Various alterations and modifications can be made to the embodiments without in any way departing from the scope or spirit of the present invention as defined in the appended claims.

What is claimed is:

1. A socket connector comprising:

a substantially rectangular dielectric housing having a plurality of terminal-passages defined therein, the housing defining opposite lateral sides thereon, one of the lateral sides outwardly forming an engaging member thereon;

a plurality of terminals received in corresponding terminal-passages; and an actuator mechanism including a shaft rotatably secured in the housing, and an actuating lever substantially perpendicularly extending from one end of the shaft, the actuating lever having protruding means positioned closer than a remaining part of the actuating lever located around the protruding means toward said one lateral side in a closed position, thereby mating with the engaging member to lock the actuating lever in said closed position; wherein the housing comprises a base and a cover slidably mounted on the base; wherein the base defines a terminal receiving section, and a first actuator receiving section extending from one end of the terminal receiving section, the first actuator receiving section defining first receiving openings and a first cavity between the first receiving openings; wherein the cover defines a hole section, and a second actuator receiving section extending from one end of the hole section, the hole section defining second receiving openings and a second cavity respectively corresponding to the first receiving openings and the first cavity; wherein the cover has two side walls depending from opposite lateral edge portions thereof; wherein the base defines two opposite lateral sides, and one of the lateral sides outwardly forms a stopper block configured with an arcuate mating face thereon.

2. The socket connector of claim 1, wherein the engaging member is a protrusion arranged on one of the side walls of the cover, and the protrusion is configured with an arcuate mating face thereon.

3. The socket connector of claim 2, wherein the shaft includes positioning portions, and an actuating portion between the positioning portions.

4. The socket connector of claim 3, wherein the mating means of the actuating lever comprises a protruding portion offset toward said one side wall of the cover.

5. The socket connector of claim 1, wherein the engaging member is a plate-shaped extrusion arranged on one of the side walls of the cover and extending toward the actuator lever.

6. The socket connector of claim 5, wherein the mating means of the actuating lever comprises a rib formed on the actuating lever and extending toward said one side wall of the cover.

7. A socket connector comprising:

an insulative housing including a base and a cover movable relative to the base along a front-to-back direction;

a plurality of terminals disposed in the base; and an actuator mechanism including a shaft retained in the housing and being able to actuate said cover to move relative to the base, and an actuating lever connected to said shaft and rotatable in a plane about and perpendicular to said shaft; wherein when said actuator mechanism is in a closed position, said actuating lever is located beside a corresponding lateral side of the housing and essentially laterally spaced from said lateral side with a distance except a middle portion thereof laterally protrudes toward and compliantly engages said lateral side.

8. The connector of claim 7, wherein said shaft extends in a lateral direction perpendicular to said front-to-back direction.

9. The connector of claim 7, wherein said actuating lever extends along said front-to-back direction when said actuator mechanism is in the closed position.

10. An electrical connector comprising:

a dielectric housing comprising a base and a cover slidably mounted on the base along a font-to-back direction, the base defining upper and lower surfaces and a plurality of terminal-passages between said upper and lower surfaces;

a plurality of conductive members received in corresponding terminal-passages;

an urging mechanism comprising a securing section secured on the housing and rotatable between a first location and a second location for actuating the cover to move relative to the base along said font-to-back direction and a cover connected to the securing section and rotatable about the securing section in a plane substantially perpendicular to the securing section; and a latching member provided on the lever and being laterally nearer toward a corresponding lateral side of the housing than a part of the lever from which the latching member at said second location extends;

wherein when the securing section is at said second location, the lever is located beside and spaced laterally a distance from said corresponding lateral side and the latching member interveningly engages said corresponding lateral side, thereby locking the securing section at said second location.

11. The connector of claim 10, wherein the latching member integrally extends from the lever.

12. The connector of claim 10, wherein said corresponding lateral side is defined on the cover.

13. The connector of claim 12, wherein the cover forms a stopping block on said corresponding lateral side.

14. The connector of claim 10, wherein the securing section has a shaft-like configuration sandwiched between the base and the cover along a direction perpendicular to said front-to-back direction.

15. The connector of claim 14, wherein the lever has a substantially rectangular cross section configuration parallel to said corresponding lateral side of the housing when the securing section is at said second location.

* * * * *